US005274984A

United States Patent [19]

Fukuda

[11] Patent Number: 5,274,984

[45] Date of Patent: Jan. 4, 1994

[54] METHODS AND SYSTEMS FOR MAKING PACKAGES

[75] Inventor: Masao Fukuda, Shiga, Japan

[73] Assignee: Ishida Scales Mfg. Co., Ltd., Kyoto, Japan

[21] Appl. No.: 909,697

[22] Filed: Jul. 7, 1992

[30] Foreign Application Priority Data

Jul. 26, 1991 [JP] Japan ..... 3-210011

[51] Int. Cl.[5] ..... B65B 9/20; B65B 41/00; B65B 41/16

[52] U.S. Cl. ..... 53/451; 53/551; 53/389.2; 53/389.4; 242/58.6; 242/79; 414/222; 414/331; 414/609; 414/908; 414/911

[58] Field of Search ..... 53/451, 551, 552, 389.2, 53/389.4; 414/331, 609, 222, 908, DIG.; 242/58.6, 79, 78.6

[56] References Cited

U.S. PATENT DOCUMENTS

| | | | |
|---|---|---|---|
| 3,546,850 | 12/1970 | Hatanaka et al. | 53/389.2 |
| 3,806,058 | 4/1974 | Münchbach | 242/79 |
| 4,236,626 | 12/1983 | Noe | 242/79 X |
| 4,524,567 | 6/1985 | Patelli | 53/552 |
| 4,695,007 | 9/1987 | Muto et al. | 53/389.4 X |
| 4,718,813 | 1/1988 | Kehlenbach | 414/911 X |
| 4,819,758 | 4/1989 | Greene et al. | 414/911 X |
| 4,948,060 | 8/1990 | Kurz et al. | 414/222 X |
| 4,998,857 | 3/1991 | Paravella | 414/911 X |
| 5,031,381 | 7/1991 | Focke | 242/58.6 X |
| 5,044,862 | 9/1991 | Herigstad et al. | 414/911 X |
| 5,090,630 | 2/1992 | Kopecky et al. | 414/911 X |
| 5,174,710 | 12/1992 | Dragos | 414/911 X |

*Primary Examiner*—Horace M. Culver
*Attorney, Agent, or Firm*—Heller, Ehrman, White & McAuliffe

[57] ABSTRACT

An improved system for making packages includes one or more packaging machines, a storage device for storing film rolls and a transporting device for transporting these film rolls to the packaging machines for loading. The packaging machines are of a type having a cantilevered film-supporting shaft for holding a film roll and sealers for longitudinally sealing overlapped side edges of a film pulled out of a film roll supported by the film-supporting shaft and horizontally sealing tubularly formed film to make bags. The film-supporting shaft extends in the forward-backward direction of the machine such that, when a plurality of these machines are arranged in a mutually side-by-side relationship, their film-supporting shafts are also in a side-by-side relationship and can be easily approached from one direction. The storage device may store the film rolls horizontally or vertically. The transporting device may be a forklift. Conveyors or cranes hung from the ceiling may be used for both for transporting and storing the film rolls. The system may be automated such that a specified film roll at a specified location in the storage device can be automatically transported to and installed in any of the packaging machines.

19 Claims, 11 Drawing Sheets

METHODS AND SYSTEMS FOR MAKING PACKAGES

BACKGROUND OF THE INVENTION

This invention relates to combined systems including a so-called form-fill-seal type packaging machine, means for storing large rolls of flexible bag-making film material therefor and means for carrying such film rolls and setting them on the packaging machine. The invention also relates to methods of using such systems.

A prior art packaging machine requiring a film roll of a type considered herein will be described first with reference to FIG. 15 which shows a so-called vertical pillow type form-fill-seal packaging machine 1' having a frame 2 supported by a base 7 so as to be vertically movable. A film roll 4 is supported by a cantilevered film-supporting shaft 3 extending perpendicularly to the forward-backward direction of the machine 1. An elongated flexible bag-making material (herein referred to as the film 13) is pulled out of the supported film roll 4 and passed through guide rollers 8 and 9 as well as a dancer roller 10 to be delivered to a former 6 of which the function is to roll the delivered film 13 into a cylindrical form. As the film 13 is formed into the cylindrical shape, its mutually overlapping side edge portions are longitudinally sealed together by means of a vertical sealer 11 such that the film 13 now assumes a tubular form. The tubularly formed film 13 is next sealed transversely at top and bottom positions by means of a horizontal sealer 12 so as to form a bag.

Film rolls are usually set on prior art packaging machines of this type manually If film rolls are made too large, therefore, more than one operator will be required to transport and load them. In part for this reason, it has been customary to make film rolls no heavier than, say, about 30 kg. Recent requirement for high efficiency of performance, however, is making it necessary to use heavier and larger film rolls with packaging machines because smaller film rolls are used up more quickly and, hence, must be exchanged more frequently.

It is therefore an object of the present invention to eliminate such disadvantages of prior art systems and methods of making packages by providing a high efficiency system with which packaging operations can be performed with ease without the necessity of frequently exchanging film rolls.

SUMMARY OF THE INVENTION

The above and other objects of the invention can be accomplished by providing a system including one or more packaging machines each having a cantilevered shaft for supporting a film roll extending in the forward-backward direction and adapted to be adjustably raised or lowered. Film-storage means for storing film rolls are located near the packaging machine and may store the film rolls horizontally or vertically. New film rolls are transported therefrom by a transporting means such as a forklift. If the film rolls are stored vertically, use may be made of a forklift supporting its fork rotatably such that a vertically oriented fill roll, after it is picked up by the forklift, can be tilted to assume a horizontal position as it is being transported to the packaging machine. The system according to the invention may include more than one packaging machine and/or more than one film-storage means. Both the film-transporting and film-storage means may be automated and robotically operated.

Alternatively, use may be made of a conveyor such as a belt system for carrying film rolls thereon or cranes hung from rails attached to the ceiling. The conveyor may be provided with a control device for identifying a specified film roll and transporting it to a pick-up station.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings

DETAILED DESCRIPTION OF THE INVENTION

Figure 1:
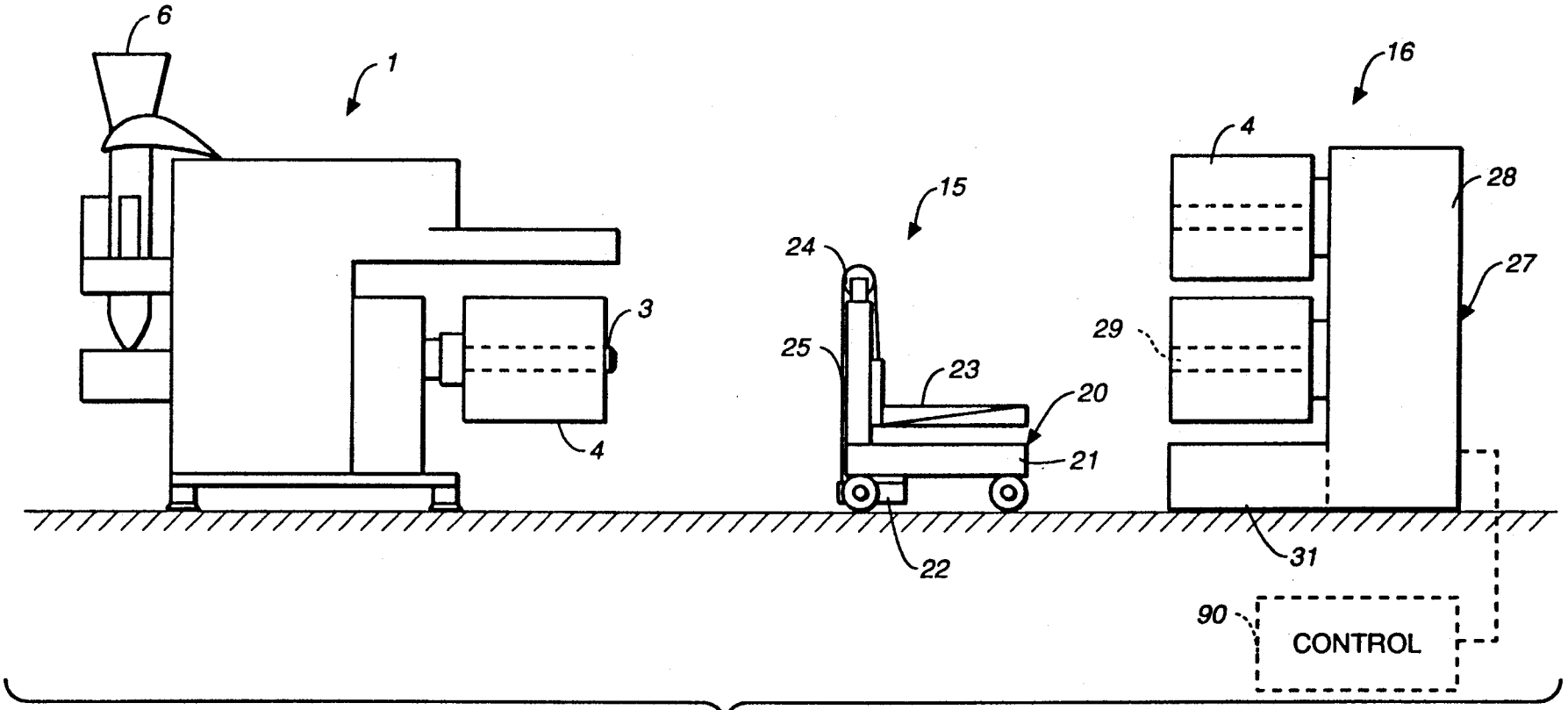
FIG. 1 is a schematic side view of a system according to the present invention.
Figure 2:
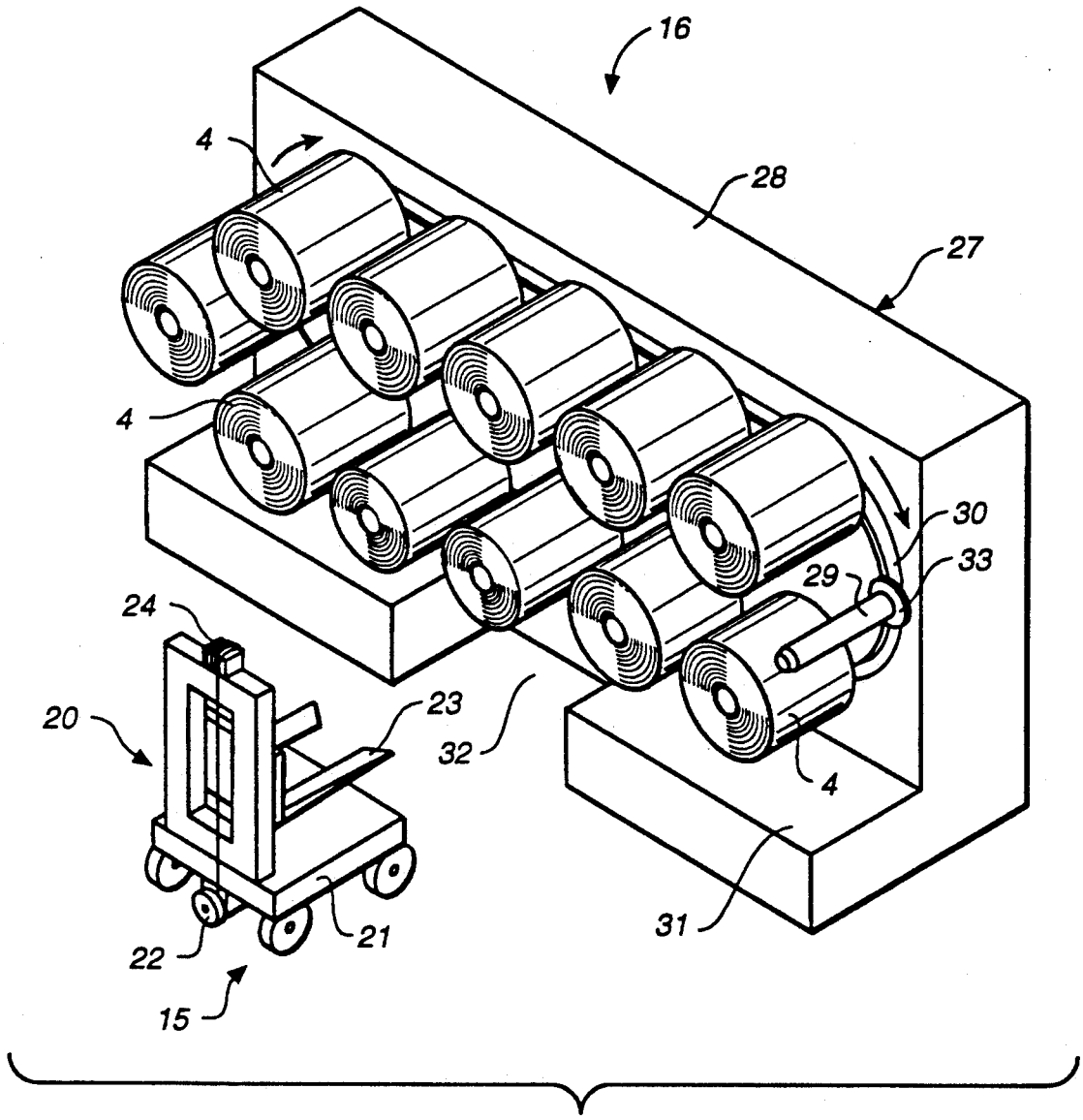
FIG. 2 is a diagonal view of a part of the system of FIG. 1.

As shown in FIGS. 1 and 2, a system according to a first embodiment of the present invention consists of a packaging machine 1, a film-transporting means 15 in the form of a forklift 20, and a storage means 16 for storing a plurality of film rolls 4. The forklift 20 may be a machine disclosed, or referred to, in U.S. Pat. No. 5,174,710 issued Dec. 29, 1992 to Dragos, and is provided with a fork 23 connected to a wire rope 25 guided by a pulley 24 and adapted to move up and down by means of a winch 22 secured to a wagon 21. The storage means 16 is comprised of a table 27 having two (left-hand and right-hand) horizontally extending base members 31 supporting a vertical wall 28 with an annular groove 30 formed on its surface in the shape of a horizontally elongated circle or two horizontal lines joined together at both ends by semi-circles. This annular groove 30 contains an endless chain (not visible)

adapted to be driven inside and along the groove 30, and a plurality of supporting shafts 29 with a flange 33 are horizontally attached to this endless chain at equal intervals. Such mechanisms and control means therefor have been used in tool holders such as Model MASBT-50 produced and sold by Yamazaki Mazak Corporation, Japan. An unloading station 32 is defined between the two base members 31.

Figure 13:
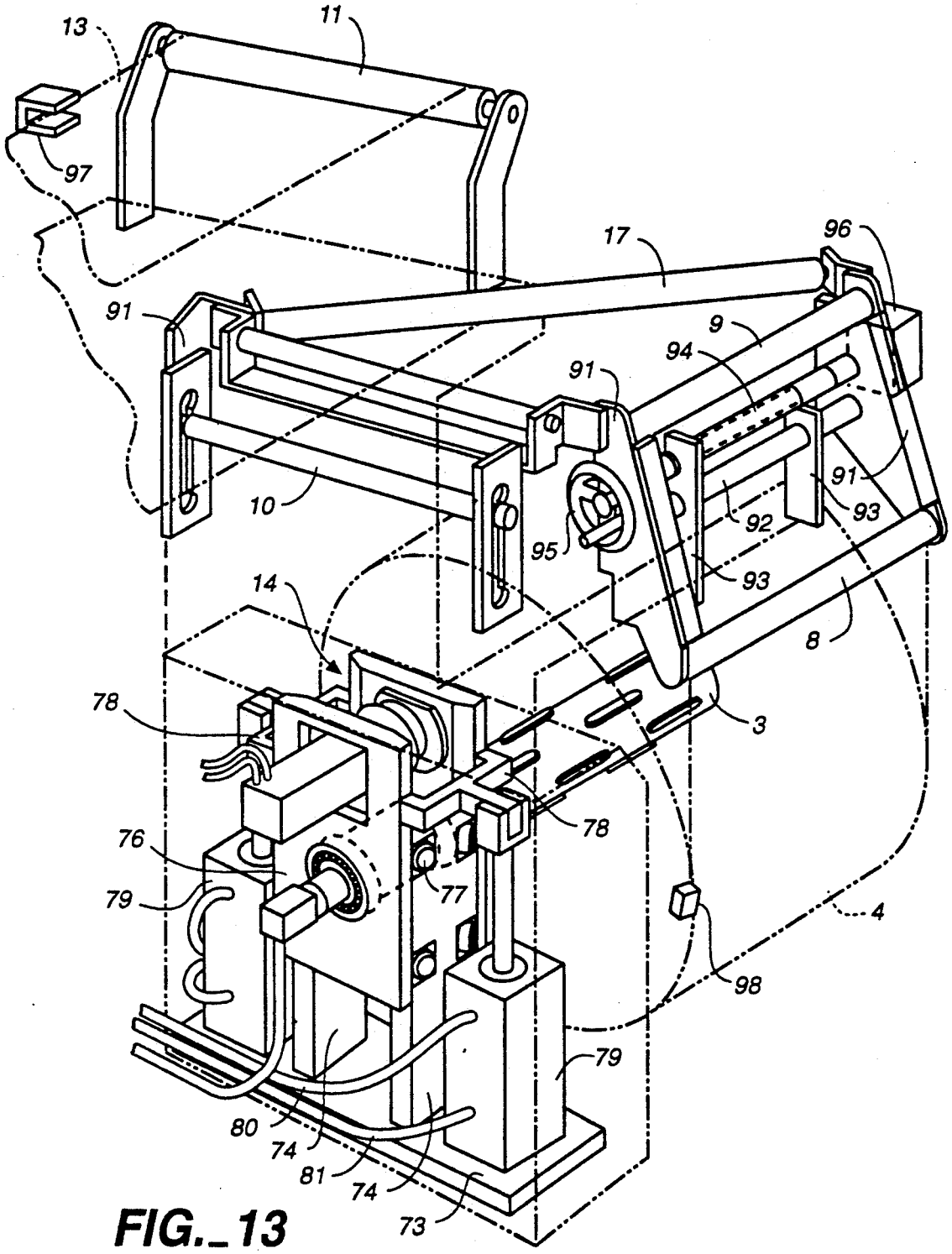
FIG. 13 is a diagonal view of a portion of a packaging machine which may be a part of a system of the present invention.
Figure 14:
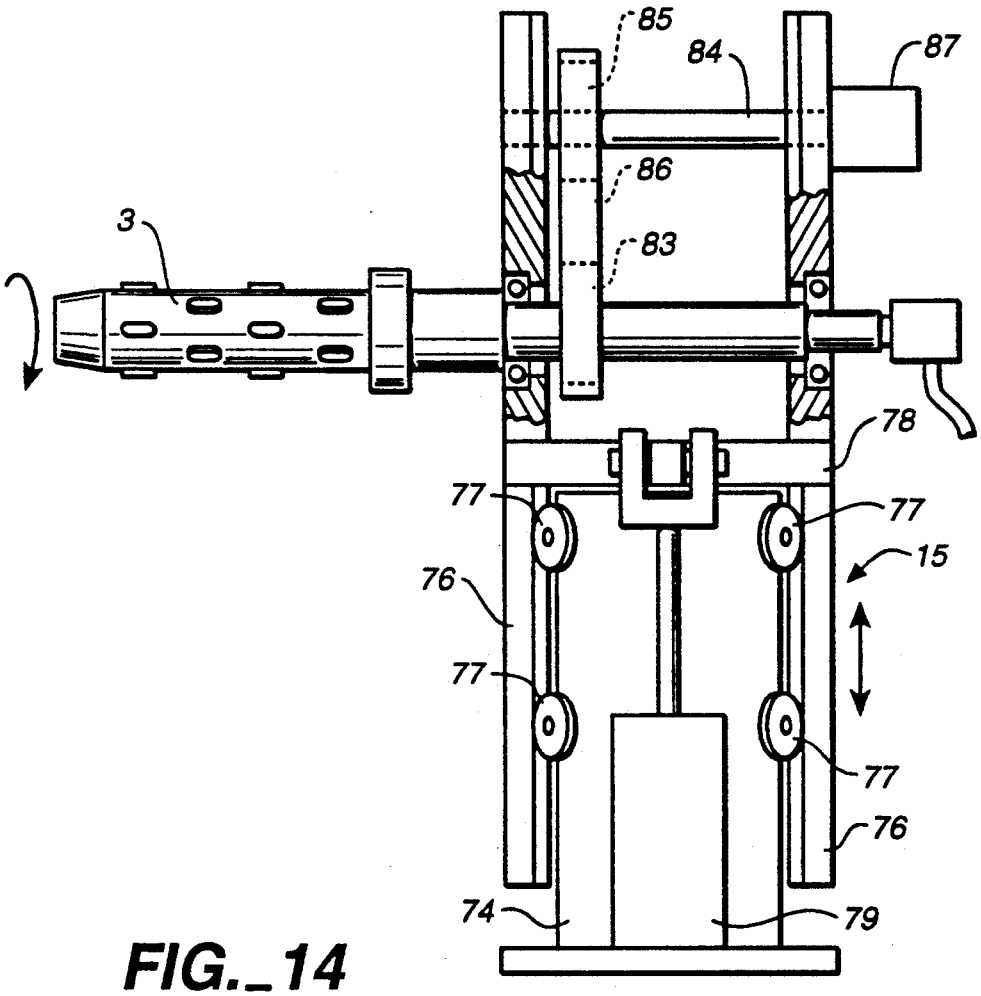
FIG. 14 is a sectional side view of a portion of the packaging machine shown in FIG. 13 including the film-supporting shaft and components which support it.
Figure 15:
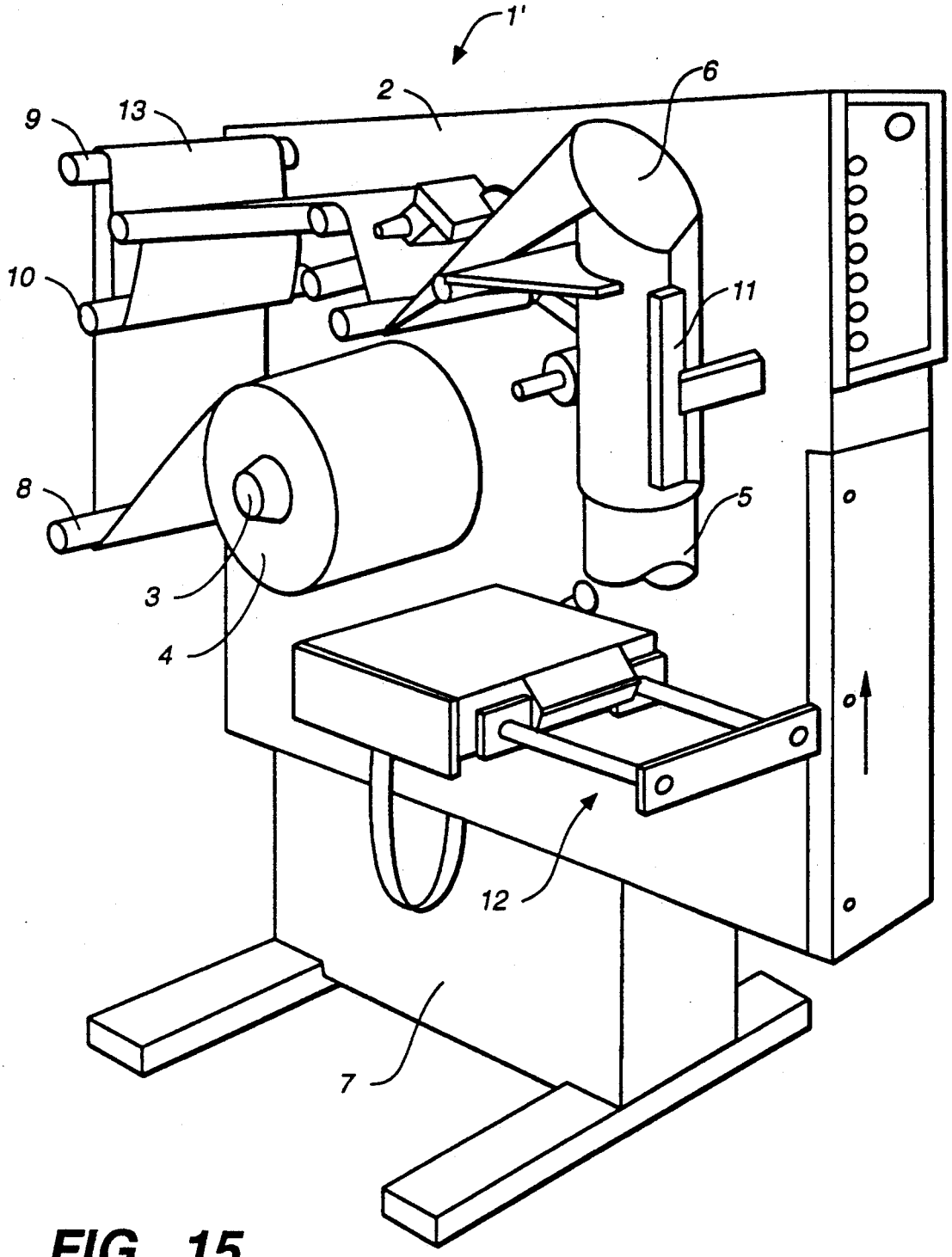
FIG. 15 (PRIOR ART)
FIG. 15 is a diagonal view of a conventional packaging machine.

The packaging machine 1 is in part structured similarly to the prior art packaging machine 1' described above with reference to FIG. 15. Those of its components which are identical or substantially similar to those described above are indicated by the same numerals and will not be explained again. A principal structural difference between the packaging machine 1 of FIG. 1 and the prior art machine 1' of FIG. 15 is, as shown more in detail in FIGS. 13 and 14, that the cantilevered film-supporting shaft 3 of the machine 1 of FIG. 1 is supported by a supporting device 14, extending in the forward-backward direction of the machine 1, ( the former 6 being considered to be at the front). Within the travel path of the film 13 defined by the guide rollers 8 and 9 as well as the dancer roller 10, there is an oblique rod 17 disposed horizontally above the film-supporting shaft 3 approximately at an angle of 45° such that the film 13, which has been pulled out of the film roll 4, is flipped over and the direction of its travel path is changed approximately by 90°. The supporting device 14 is comprised of a pair of fixed frames 74 facing opposite to each other on a base 73 and movable frames 76 which are perpendicular thereto. Rollers 77 are horizontally supported by the fixed frames 74 so as to be rotatable against the movable frames 76. The two movable frames 76 are connected together by means of connector arms 78 which are in turn connected individually to the main shafts of a pair of cylinders 79 set on the base 73 for controlling the height of the movable frames 76, and hence also that of the film-supporting shaft 3. Pipes 80 and 81 for a high-pressure fluid are connected to upper and lower portions of these cylinders 79. A drive shaft 84 is rotatably supported by the movable frames 76 above and parallel to the film-supporting shaft 3, as shown in FIG. 14. Pulleys 83 and 85 are supported respectively by the film-supporting shaft 3 and the drive shaft 84, and a belt 86 is stretched between these pulleys 83 and 85. The drive shaft 84 is adapted to be driven by a motor 87 supported by one of the movable frames 76.

The oblique rod 17, like the guide rollers 8 and 9, is supported by a pair of side frames 91 which can be moved in the forward-backward direction parallel to the film-supporting shaft 3. These side frames 91 are connected to each other by a guide rod 92 which extends horizontally between them, slidably penetrating a pair of brackets 93 affixed to the machine body. A screw rod 94, in engaging relationship with the brackets 93, is supported rotatably by the side frames 91 at both of its ends so as to be parallel to and above the guide rod 92. A manually operable handle is attached to one of its ends extending outward from the side frame 91, a motor 96 being attached to the other of its ends. Numeral 97 indicates an edge sensor for detecting an edge of the film 13 being transported. The edge sensor 97 is connected to a control device (not shown) for controlling the operation of the motor 96. Numeral 98 indicates an eye-mark detector for detecting eye-marks which may be provided along a side edge of the film 13.

With reference back to FIGS. 1 and 2, a plurality of film rolls 4 are initially loaded individually onto the supporting shafts 29. When the film roll 4 on the packaging machine 1 is to be replaced by a new one, the endless chain is driven inside the groove 30 until the desired one of the film rolls 4 on the storage means 16 is brought to the position immediately above the unloading station 32. The forklift 20 is thereafter advanced to the unloading station 32, inserting its fork 23 under the selected film roll 4, and lifts it up. The forklift 20 then moves backward away from the storage means 16 so as to remove the lifted film roll 4 from the supporting shaft 29, and moves towards the packaging machine 1. If the axis of the film roll 4 thus transported is not at the same height as the film-supporting shaft 3, the cylinders 79 on the packaging machine 1 are activated to adjust the height of the film-supporting shaft 3 such that the film roll 4 can be transferred to the film-supporting shaft 3. In this example, the forklift 20 may be replaced by a simple hand-pushed wagon structured such that a film roll 4 can be loaded with its axis held horizontally. A film roll 4 thus carried on a simple hand-pushed wagon can also be easily transferred to the film-supporting shaft 3.

Figure 3:
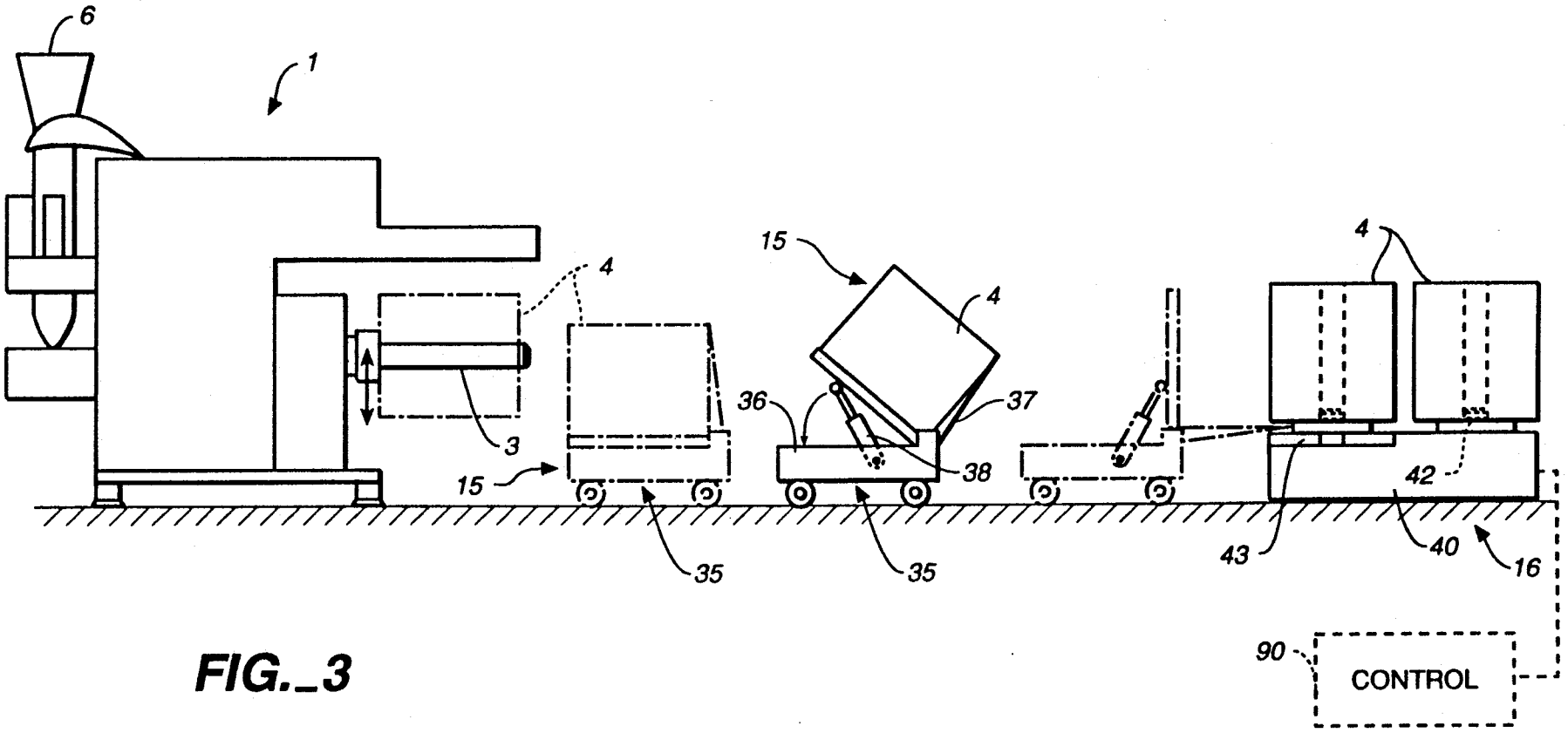
FIG. 3 is a schematic side view of another system according to the present invention.
Figure 4:
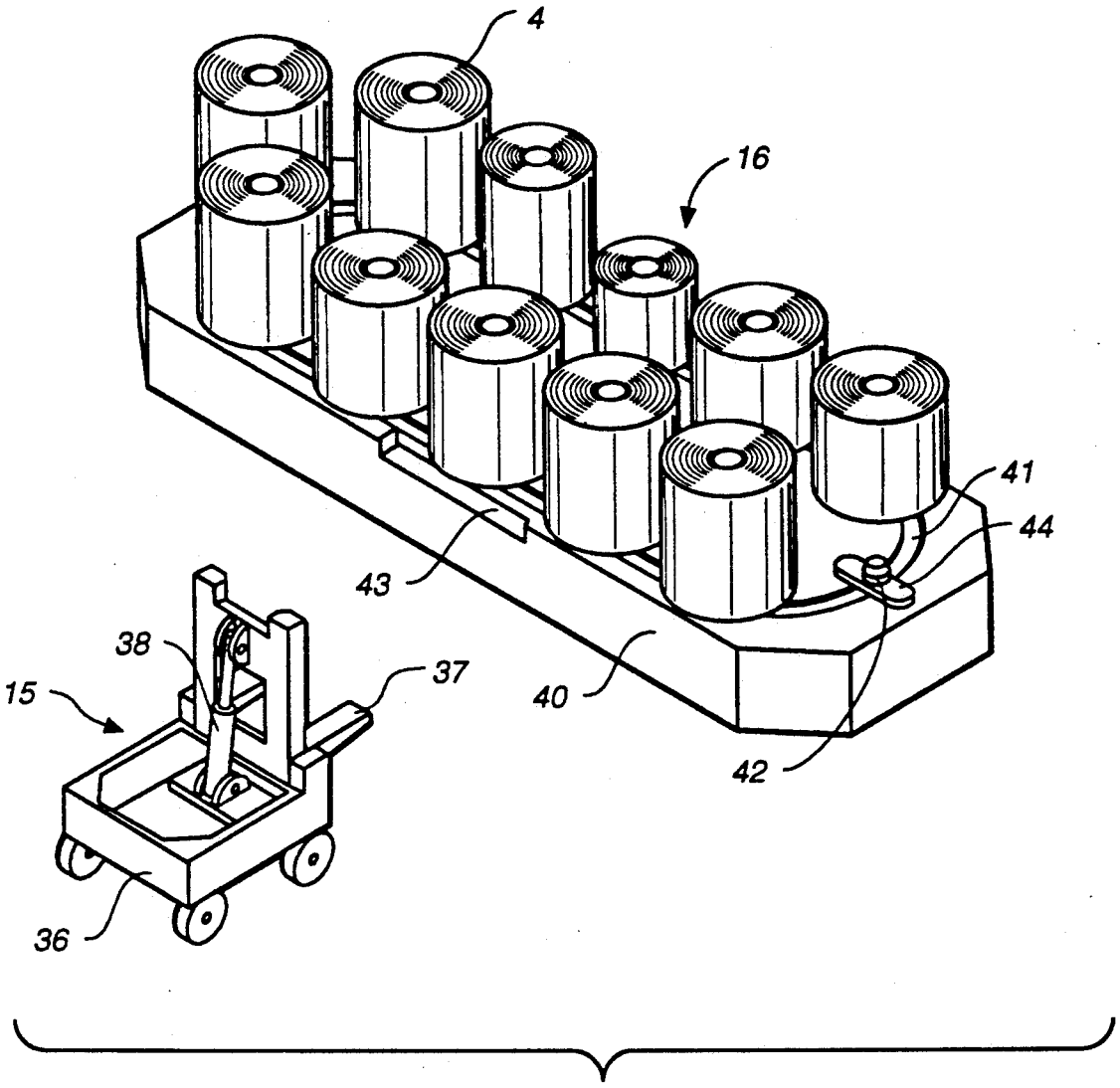
FIG. 4 is a diagonal view of a part of the system of FIG. 3.

FIGS. 3 and 4 show a system according to a second embodiment of the present invention characterized wherein its film-transporting means 15 comprises a forklift 35 having a wagon 36 axially supporting a base part of a fork 37 which can be tilted by means of a hydraulic jack 38. The storage means 16 has a support table 40 with a horizontal top surface provided with an annular groove 41 in the shape of an elongated circle or two horizontal lines joined together at both ends by semicircles like the annular groove 30 described above with reference to FIG. 2. Like the storage means 16 of FIG. 2, a plurality of film roll-supporting shafts 42 with a flange 44 are supported perpendicularly to the top surface and movably along the groove 41. An indentation 43 is formed on the top surface at a center section of the support table 40 proximal to the packaging machine 1. The supporting shafts 42 according to this embodiment of the invention are much shorter than those in the system of FIG. 2 (shown at 29). The flanges 44 are in the shape of an elongated circle or rectangular such that their width is smaller than the separation between the tines of the fork 37.

With the system thus formed, a plurality of film rolls 4 are initially loaded individually and vertically around the supporting shafts 42 on the table 40. When the film roll 4 on the packaging machine 1 is to be replaced by a new one, the fork 37 of the forklift 35 is directly inserted into the indentation 43 and lifts a film roll 4 from its supporting shaft 42. As the lifted film roll 4 is transported to the packaging machine 1, the jack 38 is operated to tilt the fork 37 by 90° such that the film roll 4 lies sideways. The horizontally lying film roll 4 is loaded onto the film-supporting shaft 3 of the packaging machine 1 in the same way as described above with reference to the first embodiment of the present invention.

Figure 5:
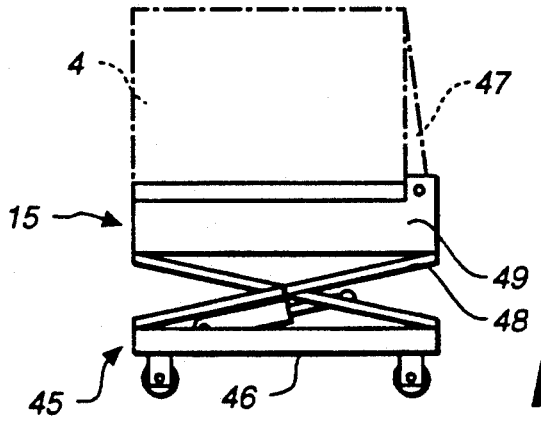
FIG. 5 is a side view of another forklift which may be used as a part of the system shown in FIGS. 3 and 4.

FIG. 5 shows a forklift 45 of another design which may be used as the film-transporting means 15 in this embodiment of the invention. This forklift 45 is characterized as having a vertically lifting mechanism 48 on a wagon 46. A fork 47 is attached to a base 49, which is supported by the lifting mechanism 48. This forklift 45 is advantageous in that the height of the film-supporting shaft 3 of the packaging machine 1 need not be varied before receiving a film roll from the forklift 45.

Operations of the film-transporting means 15 and the storage means 16 may be automated. For example, rails may be prepared for an unmanned forklift between the packaging machine 1 and the storage means 16. Operations of such a forklift are controlled by a control program The storage means 16 may be provided with a control device representing an automatic control system (schematically shown at 90 in the figures). The film rolls to be stored on the storage means 16 may be either all of the same kind or of different kinds. When different kinds of film rolls are to be stored, the control system 90 may include an input means, such as a bar code reader for specifying a kind of film roller, placed near the unloading station 32 or the indentation 43. A location number may be assigned to each position where a film roll 4 is normally stored. When new film rolls 4 are initially stored on the storage means 16, the bar code reader or the like is used to record the kind and location number of each of them. When a film roll of a particular kind is to be loaded, the number corresponding to the desired kind is inputted by the bar code or the like. The positions of film rolls of the specified kind are identified, and the control device causes the film roll of the desired kind that is closest to the unloading station 32 or the indentation 43 to be selected and retrieved.

Figure 6:
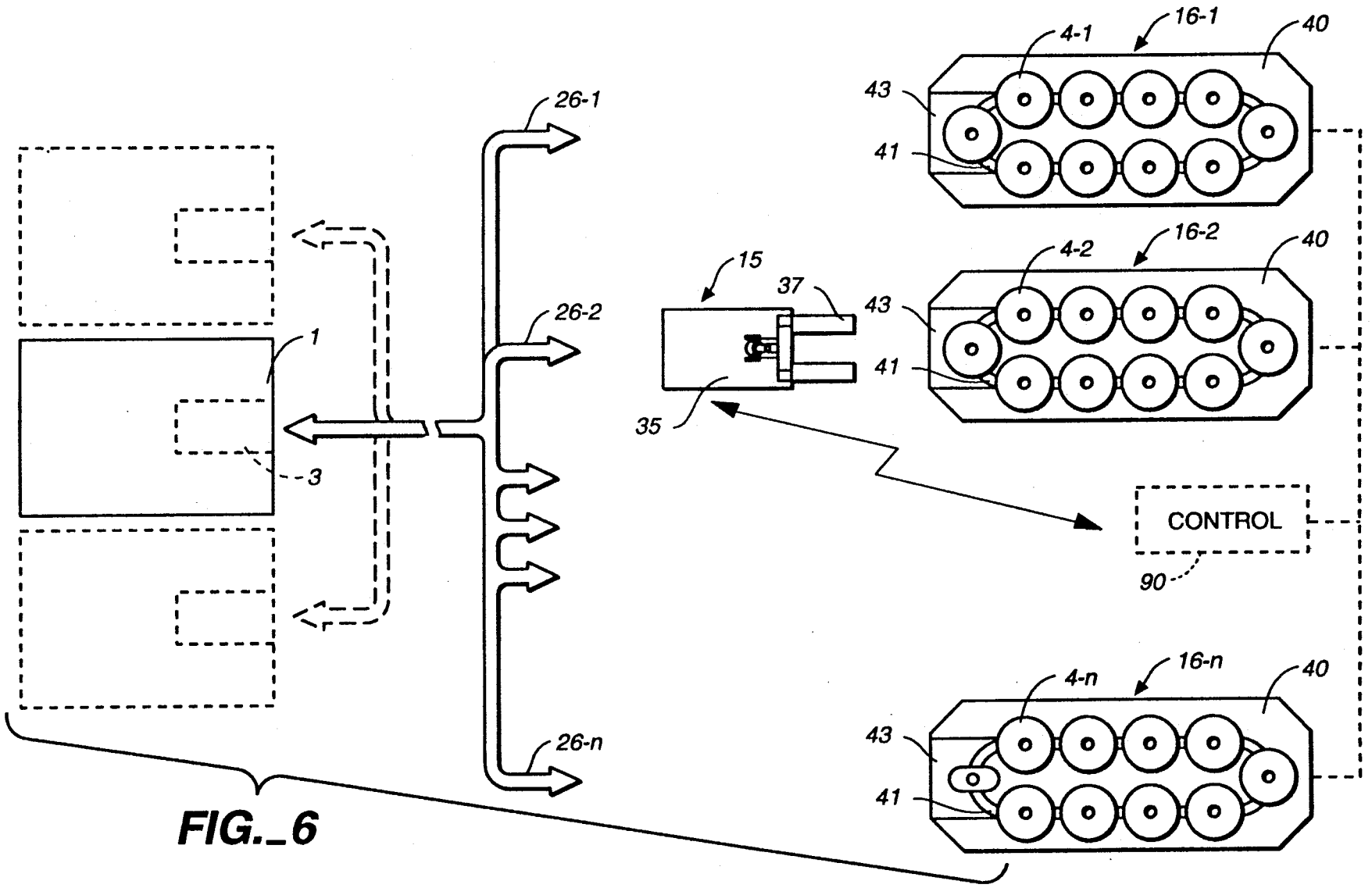
FIG. 6 is a schematic side view of still another system according to the present invention.

FIG. 6 shows a third embodiment of the invention, having a plurality of storage means 16-1~16-n storing different kinds of film rolls 4-1~4-n and tracks 26-1~26-n for a forklift 35 representing its film-transporting means 15 between individual ones of them and a packaging machine 1. This forklift 35 is of an unmanned type, responding to a command specifying one of the storage means corresponding to a desired kind of film roll The kinds of film rolls are preliminarily recorded for all storage means 16 and as soon as a desired kind of film rolls is specified, the forklift 35 selects the route leading to the particular storage means corresponding to the specified kind of film rolls, travels to the particular storage means by the selected route, automatically receives one of the film rolls from it and transports the received film roll to the packaging machine 1. Although a forklift of the type shown in FIGS. 3 and 4 is used in FIG. 6 for illustration, forklifts of different types may be automated and used in an unmanned system of the kind shown in FIG. 6. Although only one packaging machine 1 is shown (by solid lines) in FIG. 6, furthermore, more than one packaging machine may be included in a packaging system of the kind shown in FIG. 6 (as shown by broken lines), each being served by the plurality of storage means 16 and a forklift of any of the types described above. In this connection, it should be apparent that it is advantageous to have the film-supporting shaft 3 of the packaging machine 1 according to the present invention extends in the forward-backward direction, because a plurality of such packaging machines 1 can be installed in a space-saving side-by-side relationship with their film-supporting shafts 3 pointing in the same direction and next to one another so as to be all easily accessible.

Figure 7:
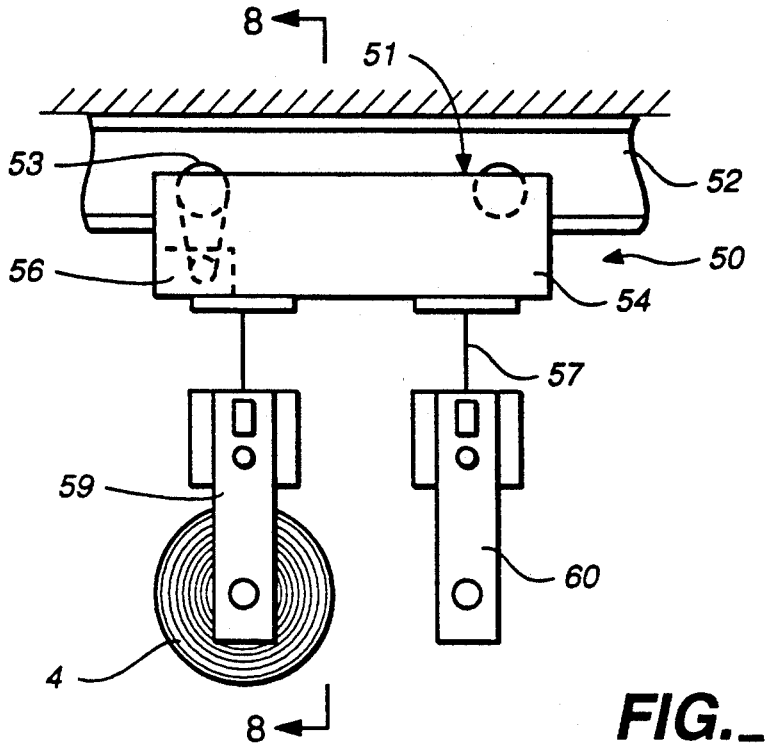
FIG. 7 is a side view of a combined means of transporting and storing a film roll for still another system according to the present invention.
Figure 8:
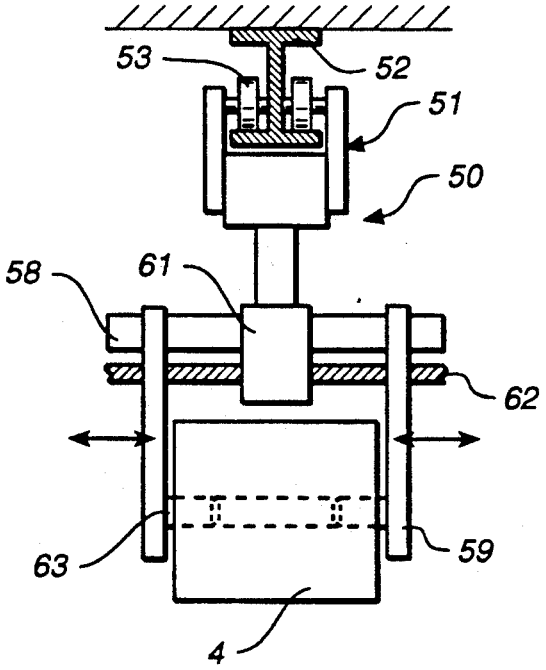
FIG. 8 is a sectional view of the transporting-storing means of FIG. 7 taken along the line 8—8 therein.
Figure 9:
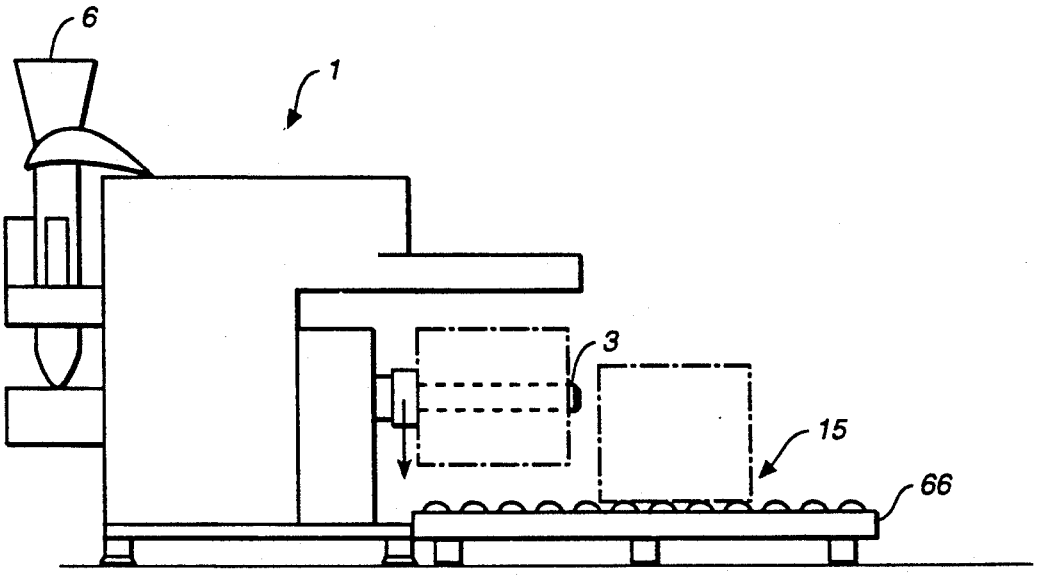
FIG. 9 is a schematic side view of an alternative film-transporting means.

FIGS. 7, 8 and 9 show a fourth embodiment of the invention characterized by the use of a combined means 50 for transporting and storing a film roll. This combined means 50 comprises a crane 51 having a hanger 54 with wheels 53 which run on rails 52 attached to the ceiling. A motor 56 for the crane 51 is supported by the hanger 54, and guide frames 58 are horizontally supported by wires 57. A pair of supporting frames 59 is slidably supported at the top by each of the guide frames 58, and a turnbuckle 62 is provided parallel to the guide frame 58, engaged with the supporting frames 59 such that the separation between the pair of supporting frames 59 can be controlled by operating a turnbuckle motor 61 disposed therebetween to rotate the turnbuckle 62. As shown in FIG. 8, the supporting frames 59 have supporting shafts 63 protruding towards each other in collinear relationship.

To use this combined means 50 for transporting a film roll from a film storage area (not shown in FIG. 7 or 8) to the packaging machine, the crane motor 56 is activated by a user's command to move the crane 51 such that one of the supporting frames 59 is brought next to the selected film roll. The turnbuckle motor 61 is then activated to rotate the turnbuckle 62 to thereby separate the pair of supporting frames 59 away from each other. After one of the supporting shafts 63 is placed opposite to the central axis of the film roll, the turnbuckle motor 61 is rotated in the opposite direction so as to move the pair of supporting shafts 63 towards each other. After the film roll 4 is thereby supported, the crane motor 56 is activated to transport the film roll 4 to the packaging machine 1 while the film roll 4 remains suspended. When the film roll 4 reaches the packaging machine 1, it is released by operating the means 50 in the reverse order and is mounted to the film-supporting shaft 3 of the packaging machine 1. In FIG. 7, numeral 60 indicates an extra pair of support frames to be used, for example, when an empty film roll is removed from the film-supporting shaft 3 of the packaging machine 1 before the new roll is set in its place.

When the crane 51 as shown in FIGS. 7 and 8 is to be used as storage means, a conveyor belt 66 may be provided as shown in FIG. 9. As soon as one of the film rolls 4 is specified, the particular one of the cranes 51 suspending the specified film roll 4 is caused to travel to the packaging machine 1, and the specified film roll 4 is placed on the conveyor 66 and transported to the film-supporting shaft 3 of the packaging machine 1 either by activating the conveyor 66 or simply by pushing. The film-supporting shaft 3 of the packaging machine 1 and the film roll 4 may be aligned either by adjusting the height of the film-supporting shaft 3 by means of the cylinders 79 shown in FIG. 13 or by adjusting the height of the conveyor 66.

Figure 11:
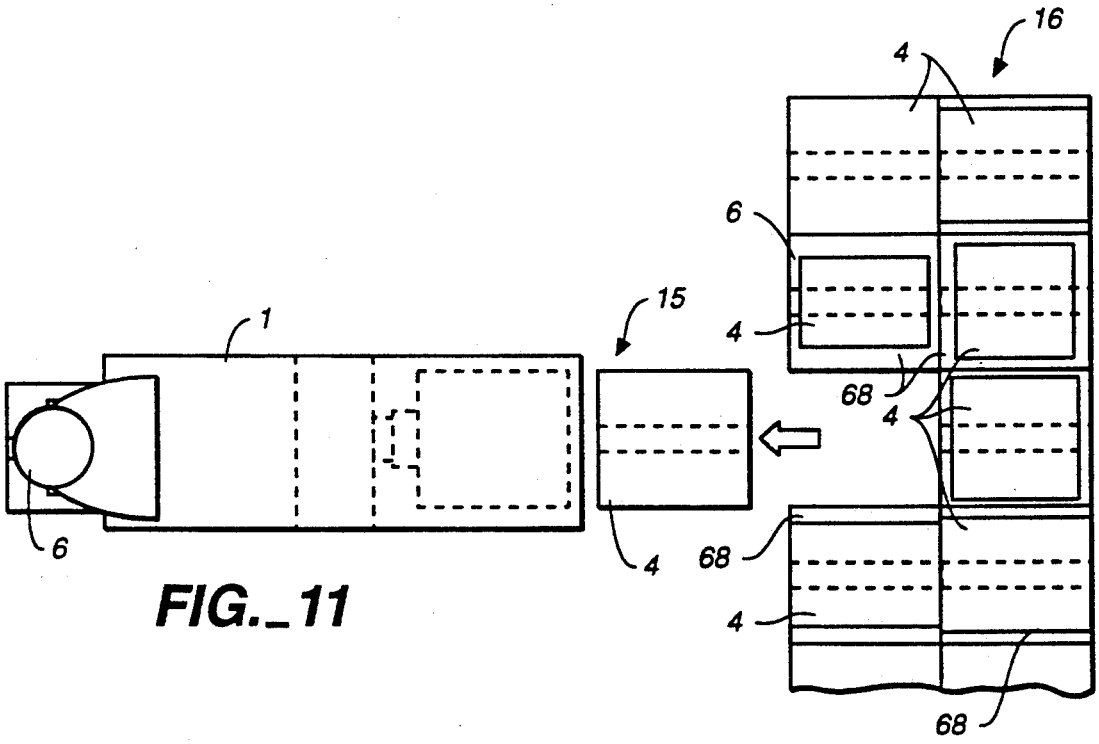
FIG. 11 is a schematic plan view of the system of FIG. 10 for the explanation of its operation.
Figure 10:
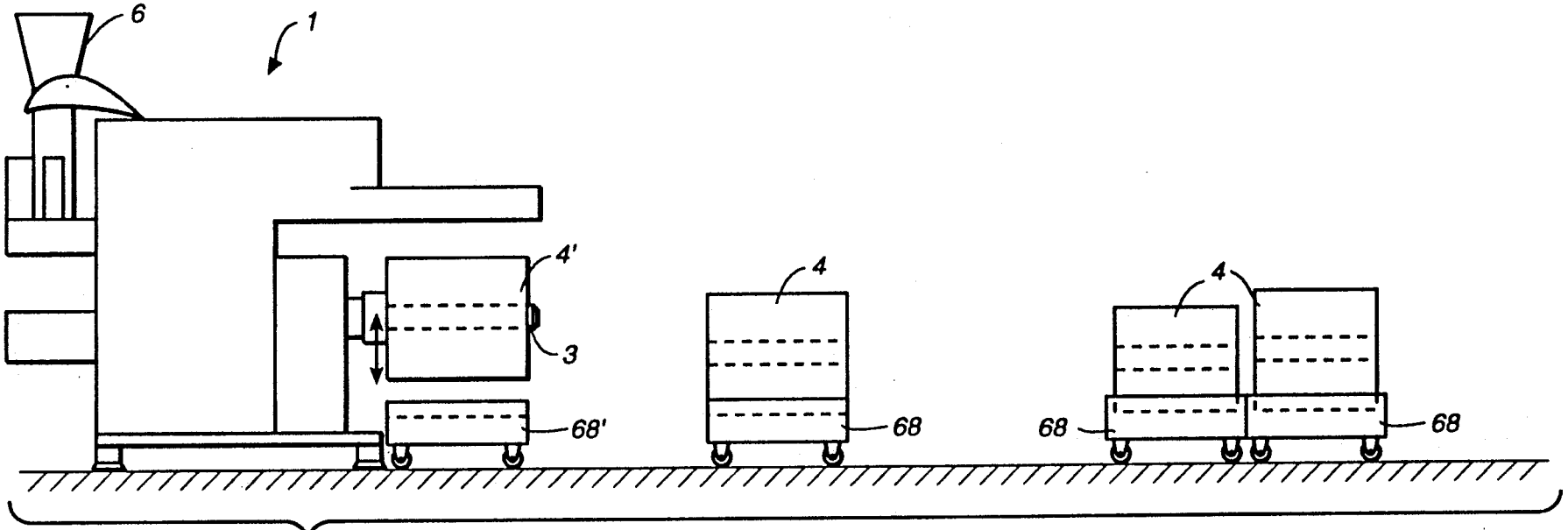
FIG. 10 is a schematic side view of still another system according to the present invention.
Figure 12:
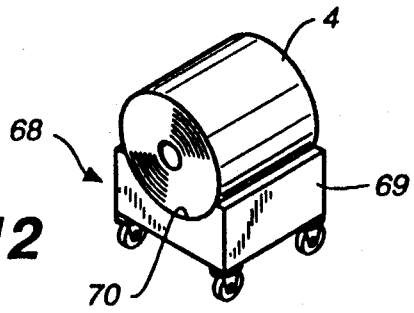
FIG. 12 is a diagonal view of the carrier of FIG. 10.

FIGS. 10, 11 and 12 show a fifth embodiment of the invention characterized by the use of a plurality of carriers 68 to serve as combination film transporting and storage means. As shown in FIG. 12, each carrier 68 is comprised of a wagon 69 with a concave top surface 70 for accepting a film roll 4. A plurality of such carriers 68 thus loaded are parked in a plurality of rows at a storage location near the packaging machine 1 as shown in FIG. 11.

In order to remove an empty film roll 4' from the packaging machine 1, an empty carrier 68' is brought below the empty film roll 4' as shown in FIG. 10, and the film-supporting shaft 3 is lowered After the empty film roll 4' is transferred onto the empty carrier 68', it is moved away from the packaging machine 1 In order to load a specified new film roll, the particular one of the carriers 68 carrying the specified new film roll 4 is identified and used as its transportation means 15. The identified carrier is transported to the packaging machine 1 and the specified film roll 4 thereon is transferred onto the film-supporting shaft 3 of the packaging machine 1 as explained above. The carrier which became empty is subsequently removed. Although a single-story carrier was illustrated in FIG. 12, use may be made of two-story carriers, each capable of carrying two film rolls, one above the other.

With systems according to the present invention, film rolls with large diameters and large weights can be easily installed on a packaging machine with simple operations. Thus, the packaging machine can be operated without having film rolls frequently exchanged. As a result, its work efficiency can be greatly improved without overworking its operators.

What is claimed is:

1. A system for making packages, said system comprising:

at least one packaging machine having a former at a forward position thereof, a cantilevered film-supporting shaft extending longitudinally backward for supporting a film roll and means for pulling a film out of a film roll supported by said film-supporting shaft, transporting said pulled-out film longitudinally forward to said former, forming said film into a tubular shape by means of said former, vertically sealing side edges of said film together and transversely sealing said vertically sealed film so as to form a bag; and film-transporting means for transporting said film roll to said packaging machine and directing said film roll to said film-supporting shaft by horizontally supporting said film roll.

2. The system of claim 1 wherein said adjusting means is a part of said packaging machine, adapted to vertically move said film-supporting shaft.

3. The system of claim 2 wherein a plurality of said packaging machines are arranged in side-by-side relationship such that the film-supporting shafts of said packaging machines are mutually parallel and next to one another.

4. The system of claim 1 further comprising film-storage means disposed proximally to said packaging machine for storing a plurality of film rolls.

5. The system of claim 4 wherein said film-storage means includes a conveyor to which are attached a plurality of film-carrying shafts each supporting a film roll therearound.

6. The system of claim 5 further comprising a control device for automatically moving said conveyor to transport a specified one of said film rolls within said film-storage means to a delivery position, said film-transporting means being controlled to robotically receive a film roll at said delivery position.

7. The system of claim 1 wherein said film-supporting shaft protrudes such that said film-transporting means can reach a position vertically separated from said film-supporting shaft.

8. The system of claim 1 further comprising adjusting means for adjusting relative height between said film-supporting shaft and said film roll on said film-transporting means.

9. The system of claim 1 wherein said film-transporting means includes a forklift.

10. The system of claim 9 wherein said forklift has a film-tiling mechanism for automatically tilting a film roll from vertical to horizontal orientation.

11. The system of claim 1 wherein said film-transporting means includes tracks between said packaging machine and said film-storage means and an unmanned vehicle adapted to ride on said tracks.

12. The system of claim 11 wherein said film-transporting means is adapted to robotically receive a specified one of said film rolls from said film-storage means and to robotically transport said received film roll to said packaging machine.

13. The system of claim 1 wherein said film-transporting means includes rails attached to a ceiling between said packaging machine and said film-storage means, a crane which is adapted to slide along said rails and to suspend a film roll therefrom.

14. The system of claim 13 wherein said film-transporting means is adapted to robotically receive a specified one of said film rolls from said film-storage means and to robotically transport said received film roll to said packaging machine.

15. A method of making packages, comprising the steps of:

providing one or more packaging machines, each having a former at a forward position thereof, a cantilevered film-supporting shaft extending longitudinally backward for supporting a film roll and means for pulling a film out of a film roll supported by said film-supporting shaft, transporting said pulled-out film longitudinally forward to said former, forming said film into a tubular shape by means of said former, vertically sealing side edges of said film together and transversely sealing said vertically sealed film so as to form a bag;

storing film rolls of one or more kinds at one or more storage locations;

supporting horizontally and transporting one of said film rolls by means of a film-transporting device from said one or more storage locations to one of said packaging machines;

transferring said transported film roll from said film-transporting device to said film-supporting shaft; and operating said packaging machine to make bags with film pulled out of said transferred film roll.

16. The method of claim 15 further comprising the steps of:

storing in a control device information on kinds and locations of said film rolls;

indicating to said control device a selected one of said kinds; and thereby causing said control device to identify one of said stored film rolls of said selected kind and to have said located film roll delivered towards said film-transporting device.

17. The method of claim 16 further comprising the steps of: indicating to said control device a selected one of a plurality of said packaging machines; and thereby causing said film-transporting device to transport said delivered film roll to said selected packaging machine.

18. The method of claim 15 further comprising the step of arranging said plurality of said packaging machines in side-by-side relationship such that the film-supporting shafts of said packaging machines are mutually parallel and next to one another.

19. The method of claim 15 further comprising the step of matching the height of said film-supporting shaft of said one packaging machine with said transported film roll on siad film-transporting device.

* * * * *